US010378524B2

(12) United States Patent
Saito et al.

(10) Patent No.: US 10,378,524 B2
(45) Date of Patent: Aug. 13, 2019

(54) HIGH-PRESSURE FUEL PUMP

(71) Applicant: HITACHI AUTOMOTIVE SYSTEMS, LTD., Hitachinaka-shi, Ibaraki (JP)

(72) Inventors: Atsuji Saito, Ibaraki (JP); Satoshi Usui, Ibaraki (JP); Masamichi Yagai, Ibaraki (JP); Minoru Hashida, Ibaraki (JP); Masayuki Suganami, Ibaraki (JP); Kenichiro Tokuo, Ibaraki (JP); Atsushi Hohkita, Ibaraki (JP); Yuta Saso, Ibaraki (JP); Kazuaki Tokumaru, Ibaraki (JP)

(73) Assignee: HITACHI AUTOMOTIVE SYSTEMS, LTD., Hitachinaka-Shi, Ibaraki (JP)

( * ) Notice: Subject to any disclaimer, the term of this patent is extended or adjusted under 35 U.S.C. 154(b) by 0 days.

(21) Appl. No.: 15/577,050

(22) PCT Filed: Jun. 13, 2016

(86) PCT No.: PCT/JP2016/067475

§ 371 (c)(1),
(2) Date: Nov. 27, 2017

(87) PCT Pub. No.: WO2017/056568

PCT Pub. Date: Apr. 6, 2017

(65) Prior Publication Data

US 2018/0171992 A1 Jun. 21, 2018

(30) Foreign Application Priority Data

Sep. 29, 2015 (JP) ..... 2015-190624

(51) Int. Cl.
*F04B 11/00* (2006.01)
*F02M 59/44* (2006.01)
(Continued)

(52) U.S. Cl.
CPC ..... *F04B 11/00* (2013.01); *F02M 55/04* (2013.01); *F02M 59/44* (2013.01);
(Continued)

(58) Field of Classification Search
CPC ... F04B 11/00; F04B 11/0033; F04B 11/0016; F04B 11/0008; F04B 11/0066;
(Continued)

(56) References Cited

U.S. PATENT DOCUMENTS 4,729,360 A * 3/1988 Fehrenbach ..... F02M 37/0041 123/447
6,763,794 B1 7/2004 Torikai et al.
(Continued)

FOREIGN PATENT DOCUMENTS

EP 1995446 A2 11/2008
EP 2055934 A2 5/2009
(Continued)

OTHER PUBLICATIONS

International Search Report, PCT/JP2016/067475, dated Jul. 26, 2016, 2 pgs.
(Continued)

*Primary Examiner* — Lindsay M Low
*Assistant Examiner* — George C Jin
(74) *Attorney, Agent, or Firm* — Volpe and Koenig, P.C.

(57) ABSTRACT

A high-pressure fuel pump capable of reducing the number of components and decreasing the manufacturing cost by processing of a pump body is provided. The high-pressure fuel pump includes a metal damper, a pump body in which a damper housing that houses the metal damper is formed, a damper cover attached to the pump body, covering the damper housing, and holding the metal damper between the pump body and the damper cover, and a holding member fixed to the damper cover and holding the metal damper from a side opposite to the damper cover. The holding member is provided with an elastic portion that urges the pump body so that the metal damper is urged toward the damper cover.

13 Claims, 12 Drawing Sheets

(51) Int. Cl.
*F04B 53/16* (2006.01)
*F02M 55/04* (2006.01)
*F02M 59/02* (2006.01)

(52) U.S. Cl.
CPC ..... *F04B 11/0033* (2013.01); *F04B 53/16* (2013.01); *F02M 59/02* (2013.01); *F02M 2200/315* (2013.01); *F02M 2200/8061* (2013.01)

(58) Field of Classification Search
CPC .... F04B 11/0091; F04B 53/16; F04B 53/001; F04B 53/02; F02M 21/0245; F02M 21/0242; F02M 59/44; F02M 59/02; F02M 59/462; F02M 59/102; F02M 59/368; F02M 63/029; F02M 63/0265; F02M 37/0041; F02M 37/0052; F02M 55/04; B23K 26/20; F02B 77/005; F02B 77/13
See application file for complete search history.

(56) References Cited

U.S. PATENT DOCUMENTS

| | | | | |
|---|---|---|---|---|
| 7,513,240 | B2 | 4/2009 | Usui et al. | |
| 8,662,868 | B2 | 3/2014 | Oikawa et al. | |
| 2009/0288639 | A1 | 11/2009 | Usui et al. | |
| 2012/0312278 | A1 | 12/2012 | Usui et al. | |
| 2013/0052064 | A1* | 2/2013 | Oikawa | F04B 11/0016 417/540 |
| 2013/0209289 | A1* | 8/2013 | Lucas | F04B 11/0008 417/395 |
| 2013/0230417 | A1* | 9/2013 | Kobayashi | F04B 11/0008 417/395 |
| 2014/0193280 | A1* | 7/2014 | Saito | F02M 55/04 417/540 |
| 2016/0298581 | A1* | 10/2016 | Nah | F02M 37/0041 |

FOREIGN PATENT DOCUMENTS

| | | | |
|---|---|---|---|
| JP | 07-259696 | A | 10/1995 |
| JP | 08-152056 | A | 6/1996 |
| JP | 11-148425 | A | 6/1999 |
| JP | 2009-264239 | A | 11/2009 |
| JP | 2011-179319 | A | 9/2011 |
| JP | 2012-207632 | A | 10/2012 |
| JP | 2013-060944 | A | 4/2013 |
| JP | 2013-064364 | A | 4/2013 |
| JP | 2014-240658 | A | 12/2014 |

OTHER PUBLICATIONS

Japanese Office Action dated Jan. 8, 2019 for the Japanese Patent Application No. 2017-542783.
European Search Report dated Mar. 25, 2019 for the European Patent Application No. 16850745.7.

* cited by examiner

HIGH-PRESSURE FUEL PUMP

TECHNICAL FIELD

The present invention relates to a high-pressure fuel pump.

BACKGROUND ART

High-pressure fuel pumps that can prevent component omission and assembly error by reducing the number of components used in assembling a metal diaphragm damper (metal damper) in a low-pressure fuel path have been known (see, e.g., PTL 1).

PTL 1 discloses that "a mechanism for reducing pressure pulsation includes a pair of metal dampers formed by joining two disk-shaped metal diaphragms over an entire circumference and forming a hermetically sealed space inside a joined portion, with gas being sealed in the hermetically sealed space of the dampers, has a pair of pressing members which give pressing force to both outer surfaces of the metal dampers at a position on the inner diameter side from the joined portion, and is unitized with the pair of pressing members being connected in a state in which they sandwich the metal dampers."

CITATION LIST

Patent Literature

PTL 1: JP 2009-264239 A

SUMMARY OF INVENTION

Technical Problem

In the technique such as the technique disclosed in PTL 1, the metal damper is held on the pump body by two members including a first pressing member (upper clamping member) and a second pressing member (lower clamping member). However, it is desirable to reduce the number of components from the perspective of decreasing the manufacturing cost.

Further, the technique such as the technique disclosed in PTL 1 requires processing of the pump body for positioning the upper and lower clamping members, whereby the manufacturing cost increases.

It is an object of the present invention to provide a high-pressure fuel pump capable of decreasing manufacturing cost and reducing the number of components.

Solution to Problem

To achieve the above object, the present invention includes a metal damper, a pump body in which a damper housing that houses the metal damper is formed, a damper cover attached to the pump body, covering the damper housing, and holding the metal damper between the damper cover and the pump body, and a holding member fixed to the damper cover and holding the metal damper from a side opposite to the damper cover, in which the holding member is provided with an elastic portion that urges the pump body so that the metal damper is urged toward the damper cover.

Advantageous Effects of Invention

According to the present invention, the number of components can be reduced and the manufacturing cost can be decreased. Other problems, structures, and effects that are not described above will be apparent from the following description of the embodiment.

DESCRIPTION OF EMBODIMENTS

Figure 1:
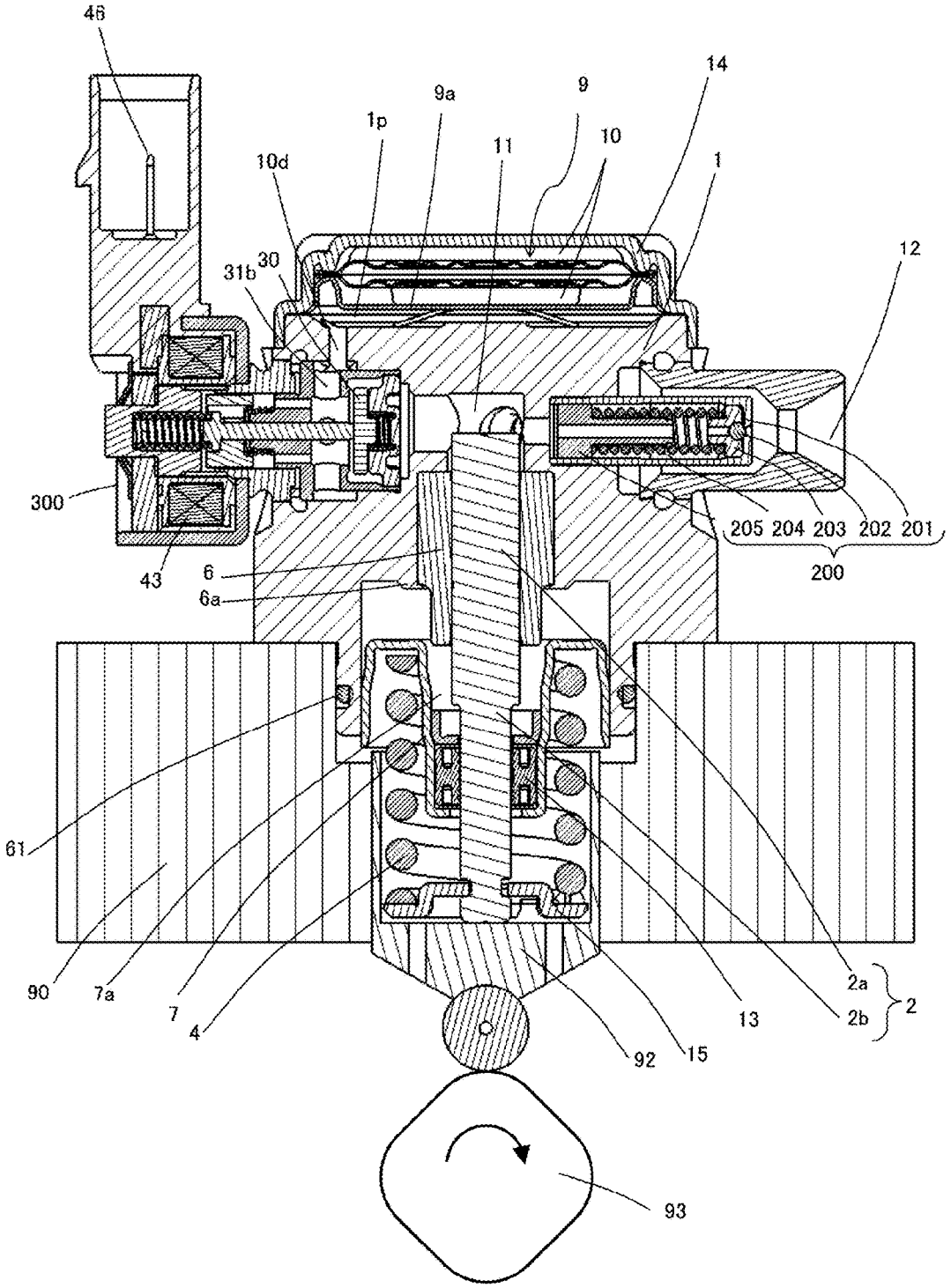
FIG. 1 is a vertical cross-sectional view of a high-pressure fuel pump according to a first embodiment of the present invention.

In the following, the structure, effect, and operation of a high-pressure fuel pump (high-pressure fuel supply pump) according to first and second embodiments of the present invention will be described. In the drawings, the same reference signs indicate the same portions.

First Embodiment

A first embodiment of the present invention will be described in detail by referring to FIGS. 1 to 5.

(Overall Structure)

Figure 5:
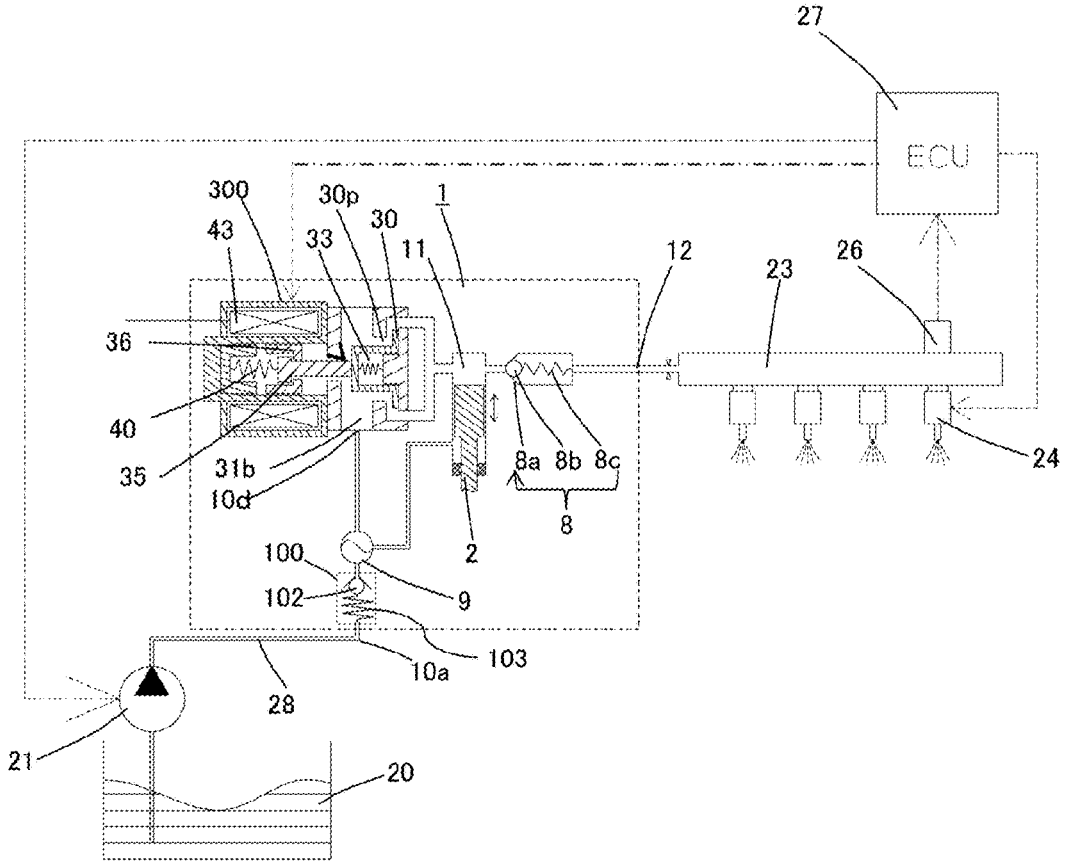
FIG. 5 illustrates the structure of an engine system to which the high-pressure fuel pump according to the first embodiment of the present invention is applied.

First, the structure and operation of a system is described using an overall structural view of an engine system illustrated in FIG. 5. A main body of a high-pressure fuel pump is indicated by a portion enclosed by a broken line, and mechanisms and parts enclosed by the broken line are integrally incorporated into a pump body 1.

Fuel in a fuel tank 20 is pumped by a feed pump 21 in accordance with a signal from an engine control unit 27 (hereinafter referred to as an ECU). The fuel is pressurized to an appropriate feeding pressure and fed to a low-pressure fuel inlet 10*a* of the high-pressure fuel pump through an intake pipe 28.

The fuel enters through the low-pressure fuel inlet 10*a* and passes through an intake joint 51 (see FIG. 2), a metal damper 9 (pressure pulsation decreasing mechanism), and an intake path 10*d* to reach an intake port 31*b* of an electromagnetic intake valve mechanism 300 that forms a variable volume mechanism.

The fuel flowing in the electromagnetic intake valve mechanism 300 passes through the intake valve 30 to flow into a pressurizing chamber 11. A cam 93 (see FIG. 1) of an engine (internal combustion engine) provides power for reciprocal motion to a plunger 2. As the plunger 2 moves reciprocally, the fuel is sucked through the intake valve 30 in a descending stroke of the plunger 2, while the fuel is pressurized during an ascending stroke. The fuel is fed under pressure through a discharge valve mechanism 8 to a common rail 23 on which a pressure sensor 26 is mounted. Injectors 24 inject fuel to the engine in accordance with the signal from the ECU 27. The present embodiment is implemented as a high-pressure fuel pump applied to a so-called direct-injection engine system in which the injectors 24 directly inject fuel into cylinder tubes of the engine.

The high-pressure fuel pump discharges a desired fuel flow of the supplied fuel in accordance with a signal from the ECU 27 to the electromagnetic intake valve mechanism 300.

Although the high-pressure fuel pump of FIG. 5 includes a pressure-pulsation-propagation preventing mechanism 100 in addition to the metal damper 9 (pressure pulsation reducing mechanism), the pressure-pulsation-propagation preventing mechanism 100 may be eliminated. The pressure-pulsation-propagation preventing mechanism 100 is not illustrated in the drawings other than FIG. 5. The pressure-pulsation-propagation preventing mechanism 100 includes a valve 102 that moves to or away from a valve seat (not illustrated), a spring 103 that urges the valve 102 toward the valve seat, and a spring stopper (not illustrated) that restricts strokes of the valve 102.

(Structure of High-Pressure Fuel Pump)

Figure 2:
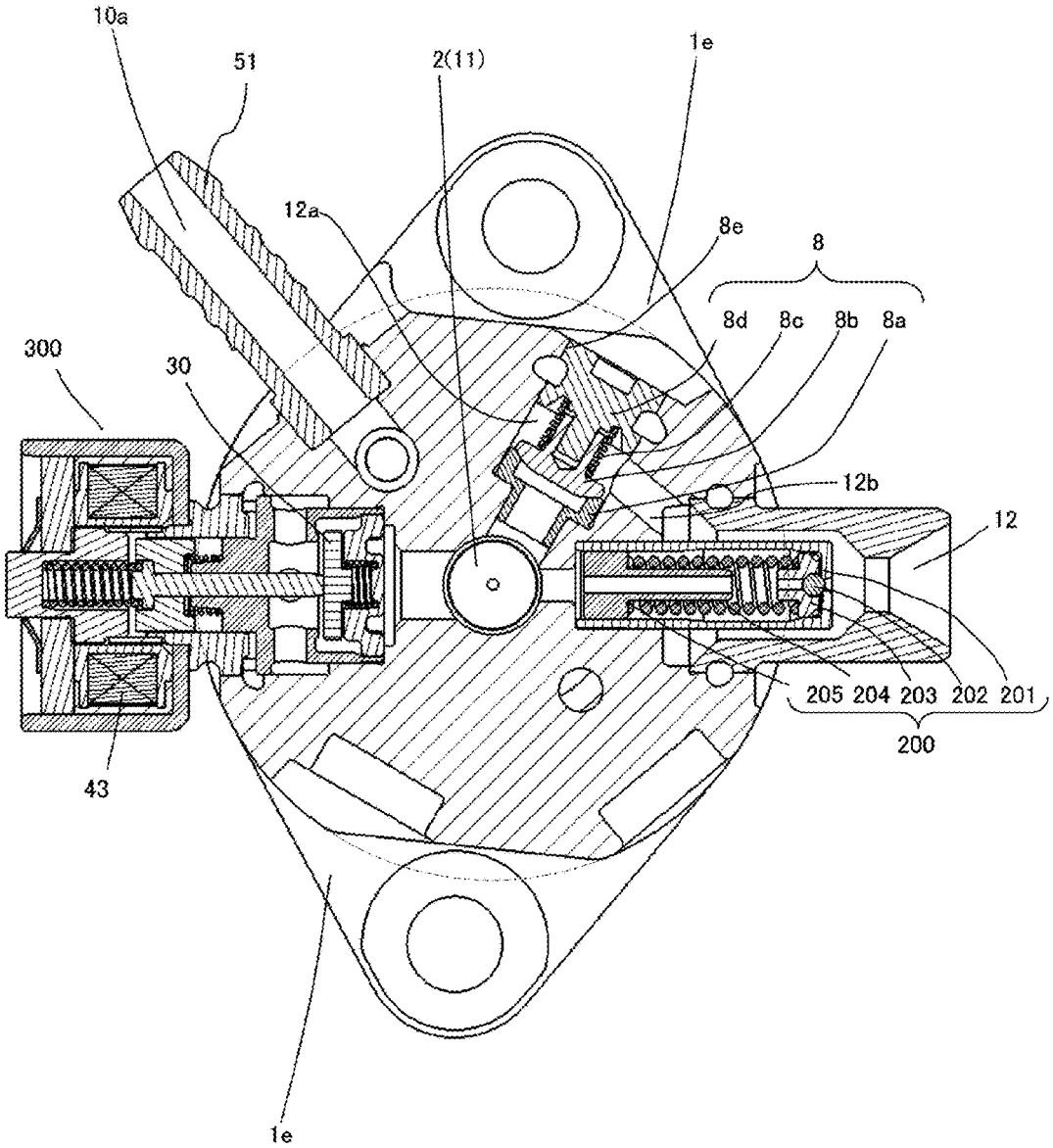
FIG. 2 is a horizontal cross-sectional view of the high-pressure fuel pump, when seen from above, according to the first embodiment of the present invention.
Figure 3:
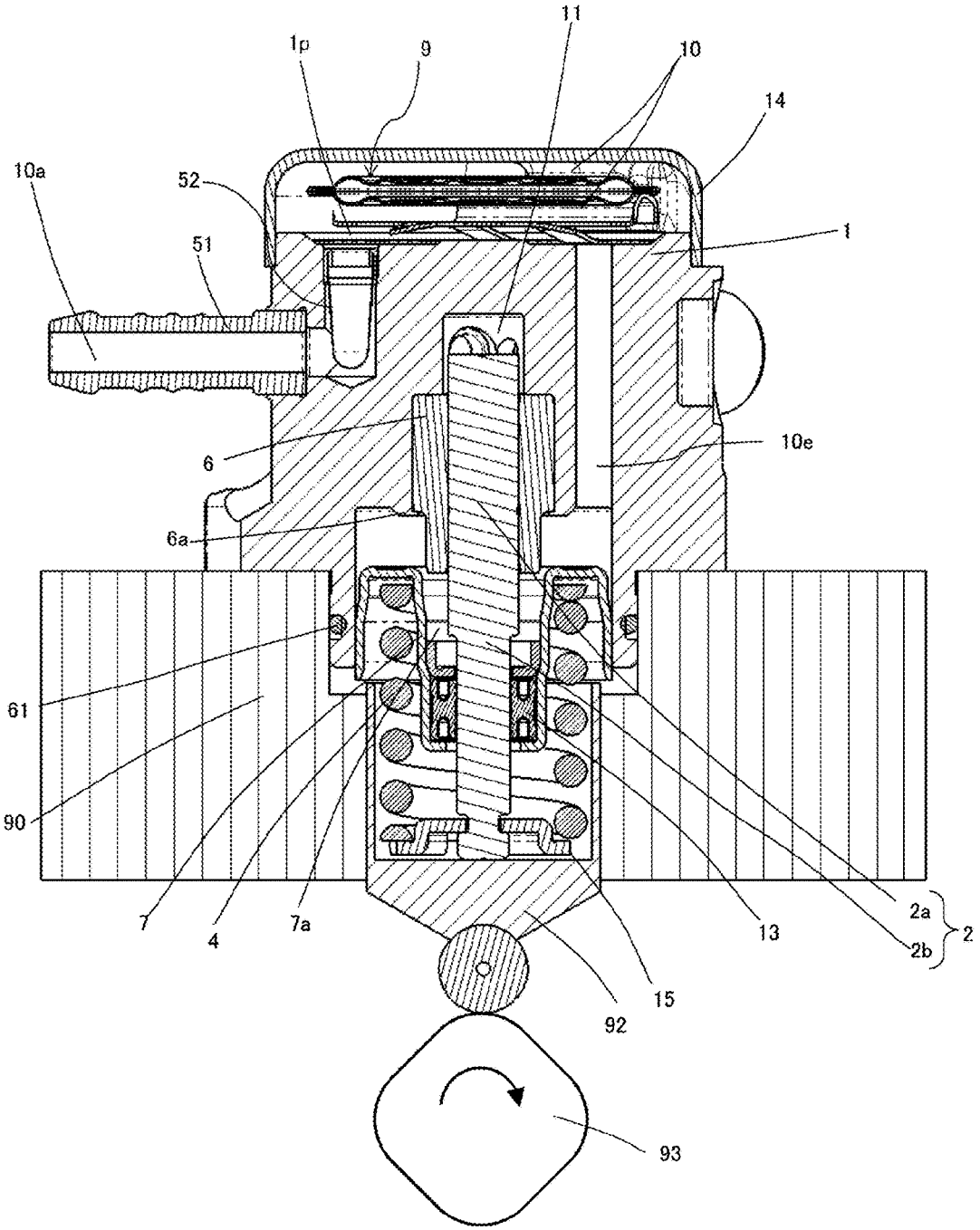
FIG. 3 is a vertical cross-sectional view of the high-pressure fuel pump, when seen from a direction different from the direction of FIG. 1, according to the first embodiment of the present invention.
Figure 4:
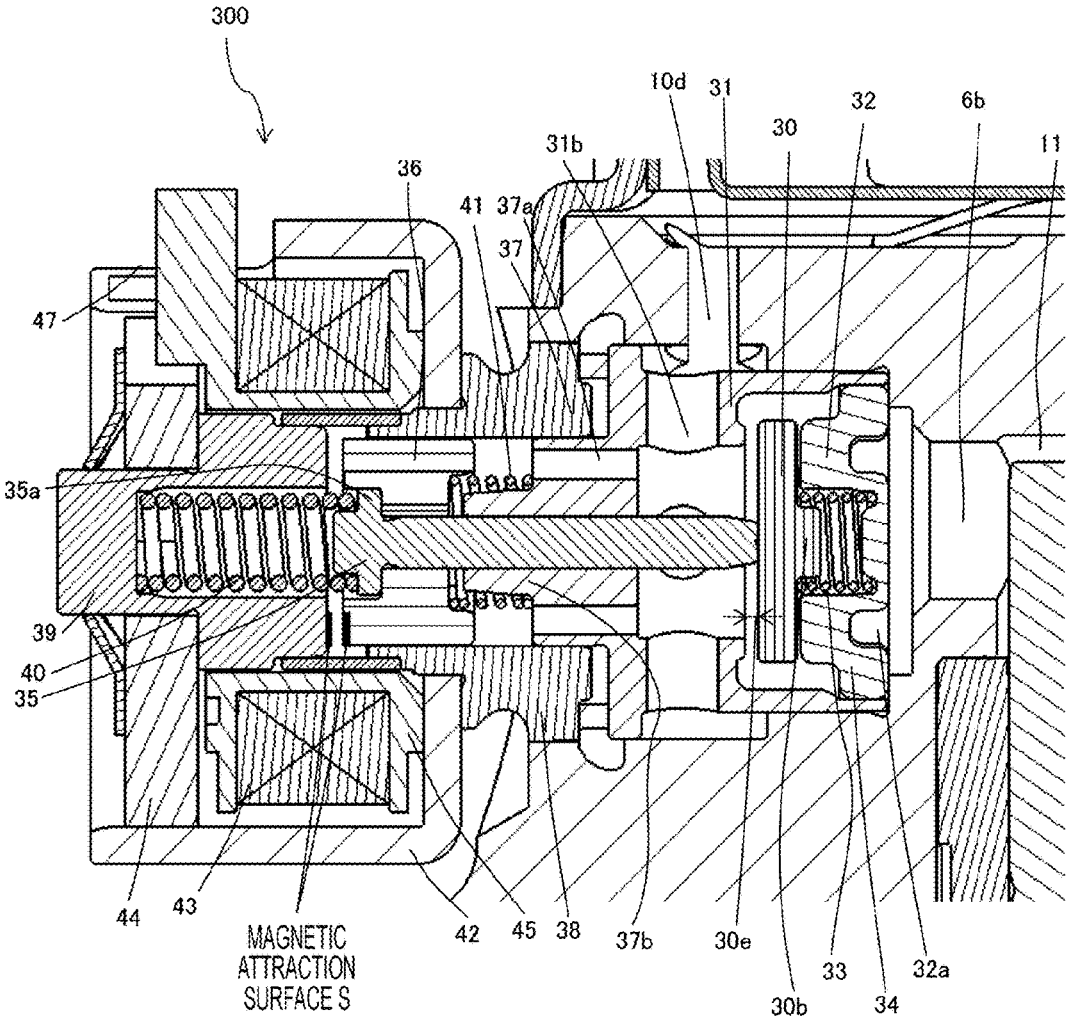
FIG. 4 is an enlarged vertical cross-sectional view of an electromagnetic intake valve mechanism of the high-pressure fuel pump when the electromagnetic intake valve mechanism is in an open-valve state according to the first embodiment of the present invention.

Next, the structure of a high-pressure fuel pump will be described by referring to FIGS. 1 to 4. FIG. 1 is a vertical cross-sectional view of a high-pressure fuel pump of the present embodiment, and FIG. 2 is a horizontal cross-sectional view of the high-pressure fuel pump when seen from above. FIG. 3 is a vertical cross-sectional view of the high-pressure fuel pump when seen from a direction different from the direction of FIG. 1. FIG. 4 is an enlarged view of the electromagnetic intake valve mechanism 300.

As illustrated in FIG. 1, the high-pressure fuel pump includes a metal damper 9, a pump body 1 (pump main body) in which a damper housing 1*p* (concave portion) that houses the metal damper 9 is formed, a damper cover 14 attached to the pump body 1, covering the damper housing 1*p*, and holding the metal damper 9 between the damper cover 14 and the pump body 1, and a holding member 9*a* fixed to the damper cover 14 and holding the metal damper 9 from the side opposite to the damper cover 14.

The high-pressure fuel pump of the present embodiment is hermetically sealed to a high-pressure-fuel-pump attaching portion 90 of the internal combustion engine with an attaching flange 1*e* (see FIG. 2), which is provided in the pump body 1, and fixed with a plurality of bolts.

As illustrated in FIG. 1, an O-ring 61 is fitted into the pump body 1 to seal the pump body 1 with the high-pressure-fuel-pump attaching portion 90, and thus prevent external leakage of engine oil.

A cylinder 6 is attached to the pump body 1 for guiding the reciprocal motion of the plunger 2 and forming the pressurizing chamber 11 with the pump body 1. Also provided are the electromagnetic intake valve mechanism 300 for feeding the fuel to the pressurizing chamber 11 and a discharge valve mechanism 8 (see FIG. 2) for discharging the fuel to a discharge path from the pressurizing chamber 11.

As illustrated in FIG. 1, the cylinder 6 is press-fitted into the pump body 1 at the outer periphery side of the cylinder 6, and the pump body is deformed at a fixing portion 6*a* toward the inner periphery side of the cylinder 6 to press the cylinder 6 upward in the drawing, to thereby seal the upper end surface of the cylinder 6 and prevent leakage of the fuel pressurized in the pressurizing chamber 11 toward a low pressure side.

A tappet 92 is provided at the lower end of the plunger 2 to convert rotational motion of the cam 93 (cam mechanism) attached to a cam shaft of the internal combustion engine into vertical motion, and the vertical motion is then transmitted to the plunger 2. The plunger 2 is crimped to the tappet 92 with a spring 4 via a retainer 15. This allows the plunger 2 to move reciprocally and vertically with the rotational motion of the cam 93.

Meanwhile, a plunger seal 13 is held at the lower end portion of the inner periphery of a seal holder 7 and disposed in slidable contact with the outer periphery of the plunger 2 in the lower portion of the cylinder 6 in the drawing. This allows the fuel in an auxiliary chamber 7*a* to be sealed during the sliding motion of the plunger 2, and prevents the fuel from flowing into the interior of the internal combustion engine. This also prevents flowing of a lubricating oil (including engine oil), which lubricates the sliding portion in the internal combustion engine, into the pump body 1.

An intake joint 51 is attached to the side portion of the pump body 1 of the high-pressure fuel pump. The intake joint 51 is connected to a low-pressure pipe for feeding the fuel from a fuel tank 20 of the vehicle, so that the fuel is fed into the high-pressure fuel pump through the low-pressure pipe. An intake filter 52 in the intake joint 51 (see FIG. 3) acts to prevent suction of a foreign object that may exist between the fuel tank 20 and the low-pressure fuel inlet 10*a* into the high-pressure fuel pump when the fuel flows.

The fuel passes through the low-pressure fuel inlet 10*a* and through the metal damper 9 and the intake path 10*d* (low-pressure fuel flow path) to the intake port 31*b* of the electromagnetic intake valve mechanism 300, as illustrated in FIG. 1.

The discharge valve mechanism 8 provided at an outlet of the pressurizing chamber 11 includes, as illustrated in FIG. 2, a discharge valve seat 8*a*, a discharge valve 8*b* that moves to or away from the discharge valve seat 8*a*, a discharge valve spring 8*c* that urges the discharge valve 8*b* toward the discharge valve seat 8*a*, and a discharge valve stopper 8*d* that determines a stroke (moving distance) of the discharge valve 8*b*. The discharge valve stopper 8*d* is bonded to the pump body 1 by welding at an abutting portion 8*e* to shut off the fuel from the outside.

If there is no pressure difference of the fuel between the pressurizing chamber 11 and the discharge valve chamber 12*a*, the discharge valve 8*b* is in a closed state by being crimped to the discharge valve seat 8*a* by urging force of the discharge valve spring 8*c*. The discharge valve 8*b* opens against the discharge valve spring 8*c* only when the fuel pressure of the pressurizing chamber 11 is larger than the fuel pressure of the discharge valve chamber 12*a*. Subsequently, the high-pressure fuel in the pressurizing chamber 11 passes through the discharge valve chamber 12*a*, the fuel discharge path 12*b*, and the fuel discharge outlet 12, and is finally discharged to the common rail 23.

When the discharge valve 8*b* opens, the discharge valve 8*b* touches the discharge valve stopper 8*d* to limit the stroke of the discharge valve 8*b*. The stroke of the discharge valve 8*b* is therefore appropriately determined by the discharge valve stopper 8*d*. This prevents flowing-back of the fuel, which has been discharged under a high pressure to the discharge valve chamber 12*a*, to the pressurizing chamber 11 again, if the stroke is so large that a closing of the discharge valve 8*b* delays, whereby a decrease of efficiency of the high-pressure fuel pump can be prevented. Meanwhile, the discharge valve stopper 8*d* guides, at its outer periphery, the discharge valve 8*b* to move only in a stroke direction when the discharge valve 8*b* repeatedly opens and closes. Thus, the discharge valve mechanism 8 acts as a check valve to limit the flowing direction of the fuel.

The pressurizing chamber 11 includes the pump body 1 (pump housing), the electromagnetic intake valve mechanism 300, the plunger 2, the cylinder 6, and the discharge valve mechanism 8.

(Operation of High-Pressure Fuel Pump)

When the plunger 2 moves toward the cam 93 in the suction stroke state with the rotation of the cam 93, the volume of the pressurizing chamber 11 increases and the pressure of the fuel in the pressurizing chamber 11 decreases. In this stroke, if the pressure of the fuel in the pressurizing chamber 11 becomes lower than the pressure at the intake port 31*b*, the intake valve 30 opens. As illustrated in FIG. 4, the fuel passes through an opening 30*e* of the intake valve 30 to the pressurizing chamber 11.

After finishing the suction stroke, the plunger 2 changes to ascending motion and starts a compression stroke. At this point, no magnetic urging force is applied, because the electromagnetic coil 43 is maintained in a non-energized state. A rod urging spring 40 is set to have an urging force necessary and sufficient to keep the intake valve 30 open in the non-energized state. The volume of the pressurizing chamber 11 decreases with the compressing motion of the plunger 2, but in this state, the fuel that has been once sucked into the pressurizing chamber 11 is returned to the intake path 10*d* through the opening 30*e* of the intake valve 30 during the open state of the valve, so that no increase of the pressure occurs in the pressurizing chamber. This stroke is referred to as a return stroke.

If the ECU 27 supplies a control signal to the electromagnetic intake valve mechanism 300 in this state, electric current flows through the electromagnetic coil 43 via a terminal 46. Accordingly, the magnetic urging force overcomes the urging force of the rod urging spring 40 and moves the rod 35 in a direction away from the intake valve 30. Thus, the intake valve 30 closes by the urging force of the intake valve urging spring 33 and a fluid force of the fuel flowing in the intake path 10*d*. After the valve has closed, the pressure of the fuel in the pressurizing chamber 11 increases with the ascending motion of the plunger 2. When the pressure becomes larger than or equal to the pressure at the fuel discharge outlet 12, the high-pressure fuel is discharged by the discharge valve mechanism 8 and supplied to the common rail 23. This stroke is referred to as a discharge stroke.

Specifically, the compression stroke of the plunger 2 (ascending stroke from bottom start point to top start point) consists of the return stroke and the discharge stroke. By controlling the timing of energization to the electromagnetic coil 43 of the electromagnetic intake valve mechanism 300, the amount of the high pressure fuel to be discharged can be controlled. If the energization timing to the electromagnetic coil 43 is made early, the ratio of the return stroke is small and the ratio of the discharge stroke is large during the compression stroke. Specifically, less fuel is returned to the intake path 10*d*, and more fuel is discharged at a high pressure. Meanwhile, if the timing of energization delays, the ratio of the return stroke is large and the ratio of the discharge stroke is small during the compression stroke. Specifically, more fuel is returned to the intake path 10*d*, and less fuel is discharged at a high pressure. The timing of energization to the electromagnetic coil 43 is controlled by a command from the ECU 27.

By controlling the timing of energization of the electromagnetic coil 43, as described above, the amount of the fuel discharged at a high pressure can be controlled to the amount required by the internal combustion engine.

(Structure of Metal Damper)

As illustrated in FIG. 1, the metal damper 9 is provided in the low-pressure fuel chamber 10 for decreasing propagation of pressure pulsation generated in the high-pressure fuel pump to the intake pipe 28 (fuel pipe). When the fuel that has once been flowed to the pressurizing chamber 11 is returned to the intake path 10*d* through the intake valve 30 (intake valve body), in order to control the volume of the fuel, while the valve is open, the pressure pulsation occurs in the low-pressure fuel chamber 10 by the fuel returned to the intake path 10*d*. However, the metal damper 9 provided in the low-pressure fuel chamber 10 is made of a metal diaphragm damper formed by bonding two corrugated disk-shaped metal plates over the outer peripheries of the metal plates, and injecting an inert gas such as argon gas into the boded plates. Such a metal damper expands and/or contracts to absorb and reduce the pressure pulsation.

The plunger 2 has a large diameter portion 2*a* and a small diameter portion 2*b*, and the volume of the auxiliary chamber 7*a* increases or decreases with the reciprocal motion of the plunger 2. The auxiliary chamber 7*a* communicates with the low-pressure fuel chamber 10 through the fuel path 10*e* (see FIG. 3). The fuel flows from the auxiliary chamber 7*a* to the low-pressure fuel chamber 10 during the descending motion of the plunger 2, while the fuel flows from the low-pressure fuel chamber 10 to the auxiliary chamber 7*a* during the ascending motion of the plunger 2.

It is, therefore, possible to decrease the fuel flow to and from the pump in the suction stroke or the return stroke of the pump, and reduce the pressure pulsation generated in the high-pressure fuel pump.

(Structure of Holding Member)

Figure 9:
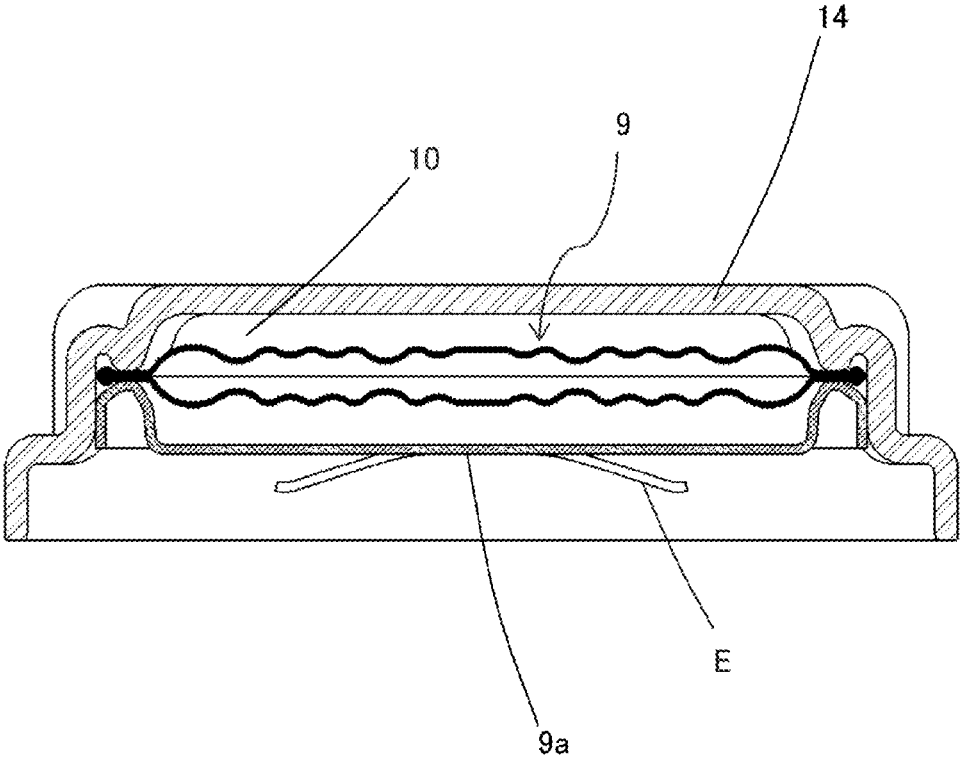
FIG. 9 illustrates a damper cover according to the first embodiment of the present invention, in which a metal damper is fitted to a holding member before a damper cover is attached to a pump body to form an independent unit.
Figure 10:
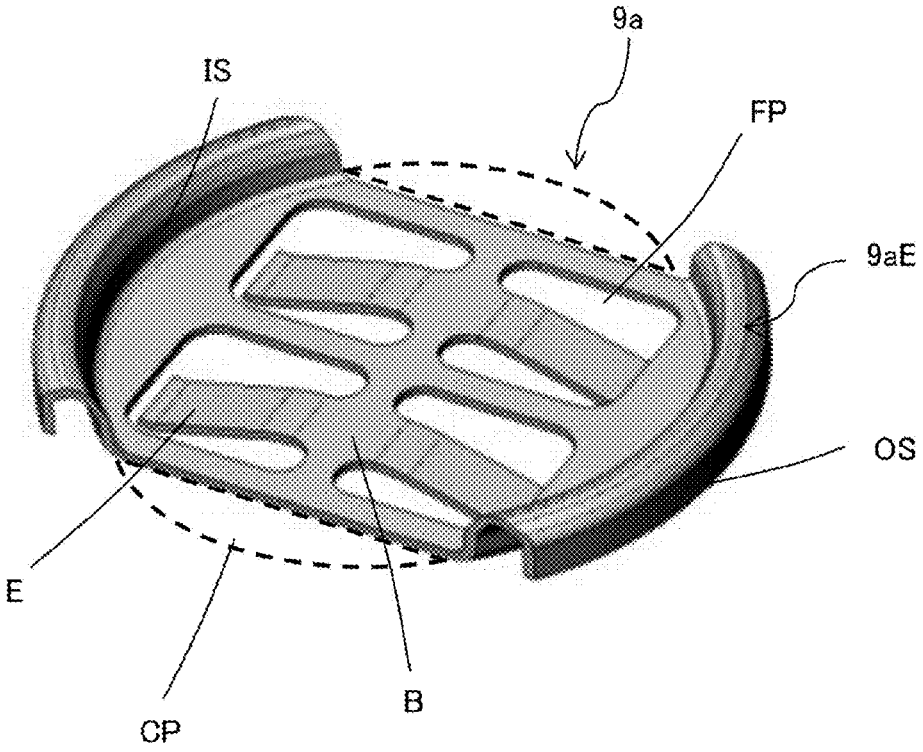
FIG. 10 is a birds-eye view illustrating an example shape of the holding member of FIG. 9.
Figure 11:
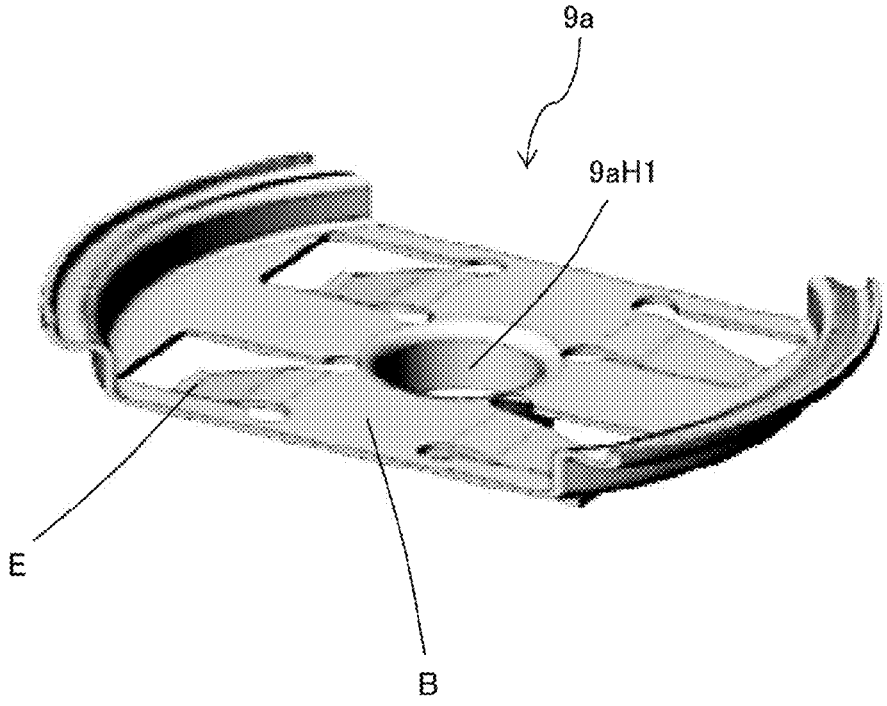
FIG. 11 is a birds-eye view illustrating a first modification of the holding member.
Figure 12:
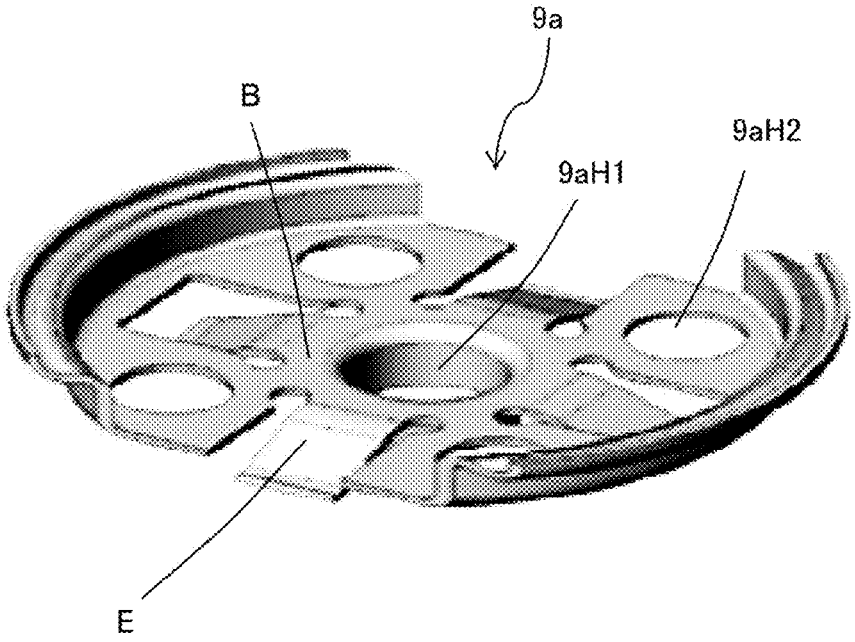
FIG. 12 is a birds-eye view illustrating a second modification of the holding member.

Next, the shape of the holding member 9*a* will be described by referring to FIGS. 9 to 12. FIG. 9 is a vertical cross-sectional view of a holding member 9*a* of the high-pressure fuel pump according the first embodiment of the present invention. FIG. 10 is a birds-eye view of the holding member 9*a* of FIG. 9. FIG. 11 is a birds-eye view of a first modification of the holding member 9*a*. FIG. 12 is a birds-eye view of a second modification of the holding member 9*a*.

As illustrated in FIG. 9, the holding member 9*a* is provided with an elastic portion E that urges the pump body 1 so that the metal damper 9 is urged toward the damper cover 14. Specifically, the holding member 9*a* includes the elastic portion E that has a spring reaction force for urging the pump body 1 to urge the metal damper 9 toward the damper cover 14. The spring reaction force enables the metal damper 9 (diaphragm) to be held more reliably to the pump body 1. No processing is required for the pump body 1 for the positioning of the holding member 9*a*, so that the manufacturing cost can be reduced.

Meanwhile, as illustrated in FIG. 10, the holding member 9*a* includes a fuel path FP formed simultaneously with the elastic portion E, when the elastic portion E is cut and raised, to provide the fuel path FP between the pump body 1 side and the metal damper 9 side. Unlike PTL 1, the processing can be simple, as it is not necessary to perform processing on the pump body 1 side to form the path. In addition, only one holding member 9*a* is needed, so that the cost reduction can be achieved.

Preferably, as illustrated in FIG. 9, the holding member 9*a* is fixed to the damper cover 14 by press-fitting and the metal damper 9 is fitted to the damper cover 14 by the holding member 9*a* to form an independent unit before the damper cover 14 is attached to the pump body 1. By fitting the damper cover 14 to the pump body 1 after assembling the independently unitized damper unit with the cover, the metal damper 9 can simultaneously be held on the pump body 1

As illustrated in FIG. 10, the elastic portion E of the holding member 9*a* has a bottom portion B which is formed in an approximately flat shape, with part of the bottom portion B being cut and raised toward the pump body 1 side. Thus, the elastic portion E can be formed easily.

More specifically, the elastic portion E has the bottom portion B, an inner peripheral side portion IS formed from the bottom portion B to the damper cover 14, and an outer peripheral side portion OS formed from the side portion (inner peripheral side portion) to the bottom portion B. The outer peripheral side portion OS is press-fitted to the damper cover 14 to fix the holding member 9*a* to the damper cover 14. This allows the holding member 9*a* and the damper cover 14 to be fixed easily. In addition, the holding member 9*a*, the metal damper 9, and the damper cover 14 can be unitized easily.

Meanwhile, the holding member 9*a* and the elastic portion E are preferably made of a single press plate. Thus, the number of processing steps is reduced, and the manufacturing cost is decreased. Preferably, only the elastic portion E of the holding member 9*a* is formed to touch the pump body 1. Thus, the assembling can be performed easily, because there is no need to consider other assembly tolerance. As illustrated in FIG. 10, the holding member 9*a* is provided with cutouts on both left and right sides in an approximately rectangular shape, when seen from the damper cover 14 side. By providing the cutouts, communication paths CP can easily be formed as illustrated in FIG. 10. Preferably, the cutouts are provided symmetrically on the left and right sides.

Further, the holding member 9*a* has the bottom portion B and an edge portion 9*a*E (side portion) formed from the bottom portion B to the damper cover 14. Preferably, the edge portion 9*a*E and the under surface of the damper cover 14 hold the metal damper by sandwiching the metal damper from above and below. Thus, the metal damper 9 can be held by a smaller number of components (1 component) which is smaller than the conventional number of components (2 components).

Figure 6:
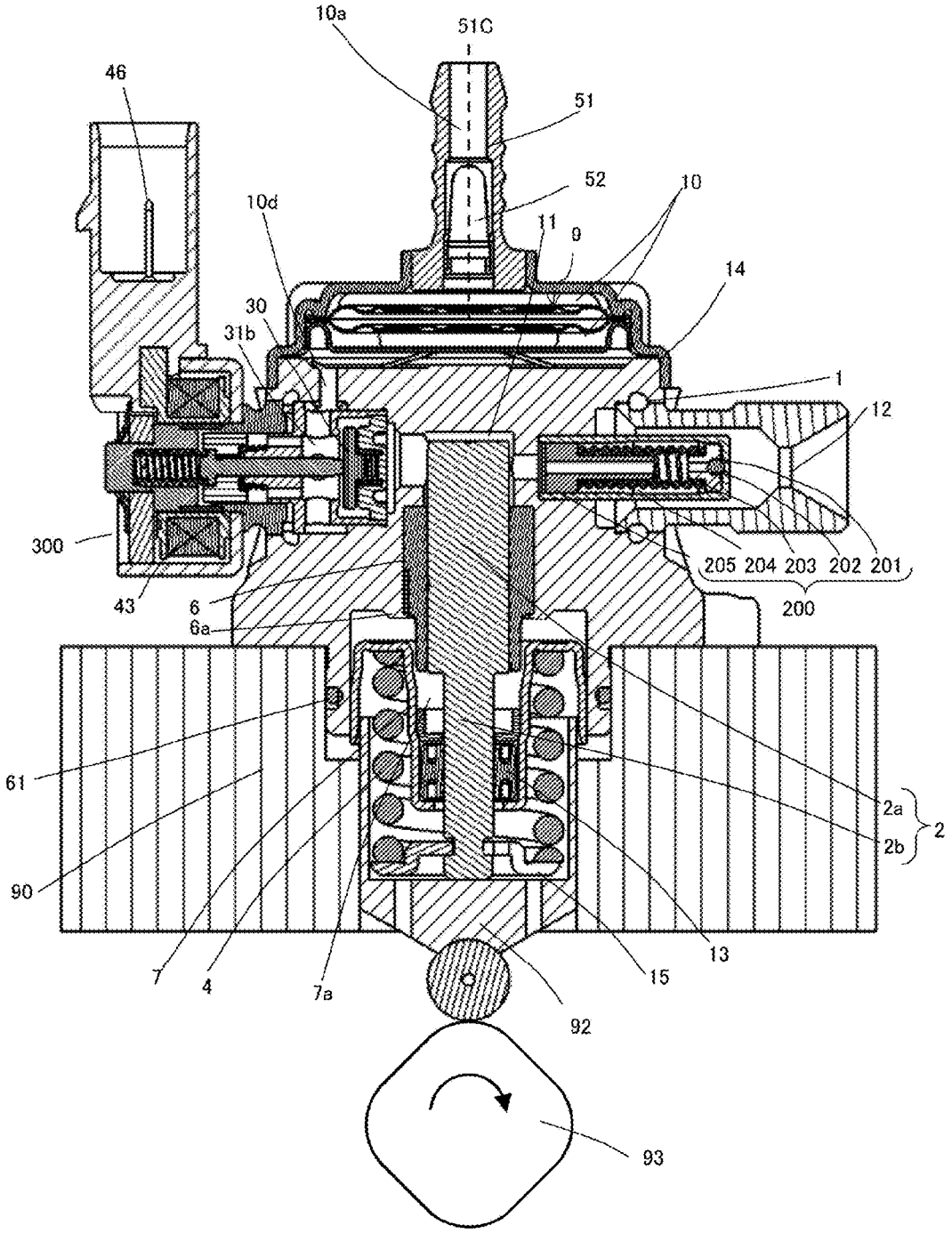
FIG. 6 is a vertical cross-sectional view of a high-pressure fuel pump according to a second embodiment of the present invention.

As illustrated in FIG. 10, the edge portion 9*a*E is formed in the holding member 9*a* in a half-pipe shape and includes the inner peripheral side portion IS and the inner peripheral side portion IS. Assuming that the lower side is the direction from the damper cover 14 toward the pump body 1 and the upper side is opposite to the lower side, the lower end portion (lower end) of the damper cover 14 is located lower than the bottom portion B over the entire region of the bottom portion B. The individual damper unit can therefore be formed without the bottom portion B touching the pump body. Further, in the present example, the lower end of the damper cover 14 is located on the side lower than the elastic portion E over the entire region of the elastic portion E, as illustrated in FIGS. 1, 4, and 6.

Preferably, as illustrated in FIG. 11, a hole 9*a*H1 is formed in the bottom portion B of the holding member 9*a*, in addition to the elastic portion E, which communicates with the metal damper 9 side and the pump body 1 side. This structure allows the fuel path to be formed between the metal damper 9 side and the pump body 1 side.

In FIG. 11, the hole 9*a*H1 has a cylindrical portion extending toward the pump body 1 side, but such a cylindrical portion may not be provided. As illustrated in FIG. 12, holes 9*a*H2 may also be provided in the bottom portion B in addition to the hole 9*a*H1 provided in the central portion of the bottom portion B of the holding member 9*a*. Preferably, the holes 9*a*H2 are formed on the outer periphery side of the holding member 9*a* relative to the central portion of the bottom portion B, and provided radially at equal intervals. The holes 9*a*H1 and 9*a*H2 facilitate spreading of the fuel to both upper and lower surfaces of the metal damper 9, to thereby improve the effect of decreasing pulsation.

As illustrated in FIG. 10, the holding member 9*a* is not in a circular shape when seen from above, but in a shape with both ends being cut out. Specifically, the inner peripheral side portion IS and the outer peripheral side portion OS formed from the side portion (inner peripheral side portion IS) to the bottom portion B are formed partially in the outer periphery, and in the other portions of the holding member 9*a*, the communication path CP that communicates with upper and lower sides of the metal damper 9 are formed.

Therefore, the lower space (pump-body-side space) under the pump body 1 and the metal damper 9 (diaphragm damper) can communicate with the upper space (damper-cover-side space) through the communication path CP.

The conventional metal damper is held by the holding member from above and below and fixed to the pump body, and the holding member is disk-shaped over the entire circumference. Therefore, the lower space and the upper space of the metal damper cannot communicate with each other. It has been necessary in the conventional metal damper to process the pump body to form the communication path.

In contrast, the structure of the holding member 9*a* illustrated in FIGS. 9 to 12 includes the communication paths CP formed partially in the outer periphery of the holding member 9*a*, so that the lower space (pump-body-side space) and the upper space (damper-cover-side space) of the metal damper 9 can communicate with each other without any processing. Thus, the manufacturing cost can be decreased.

As described above, the present embodiment can reduce the number of components and decrease the manufacturing cost.

Second Embodiment

Figure 7:
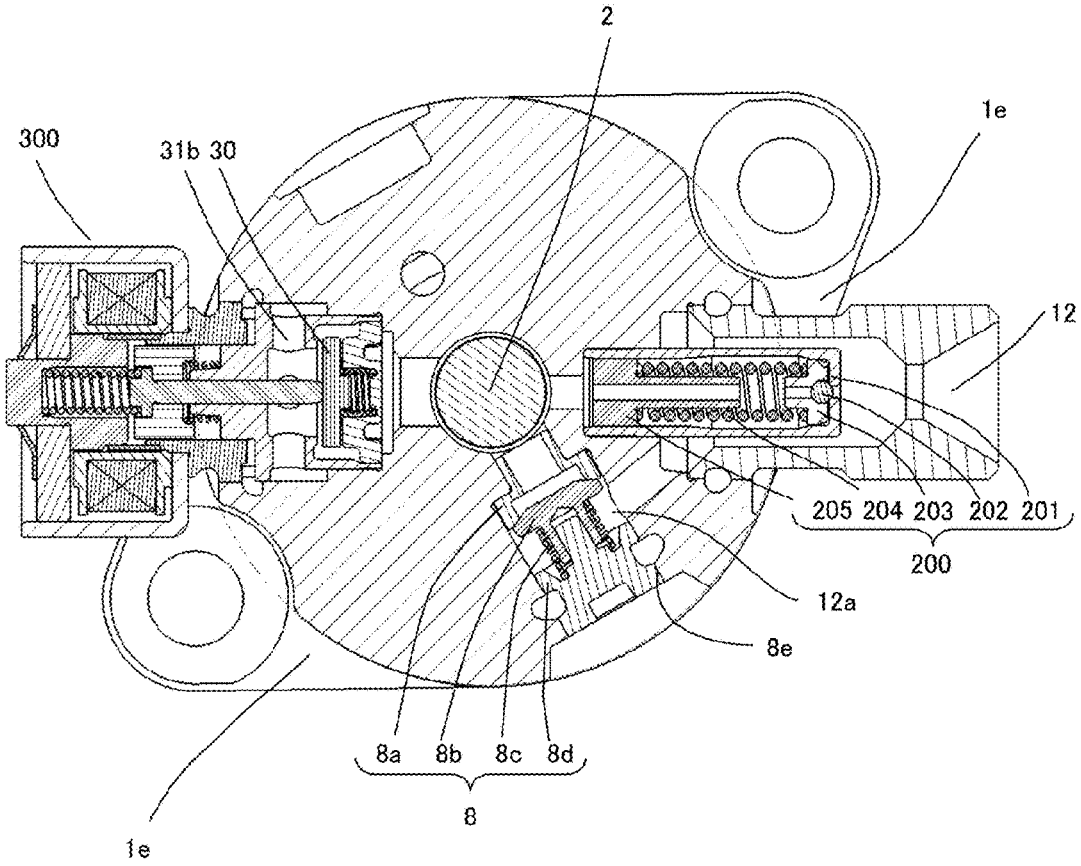
FIG. 7 is a horizontal cross-sectional view of the high-pressure fuel pump, when seen from above, according to the second embodiment of the present invention.
Figure 8:
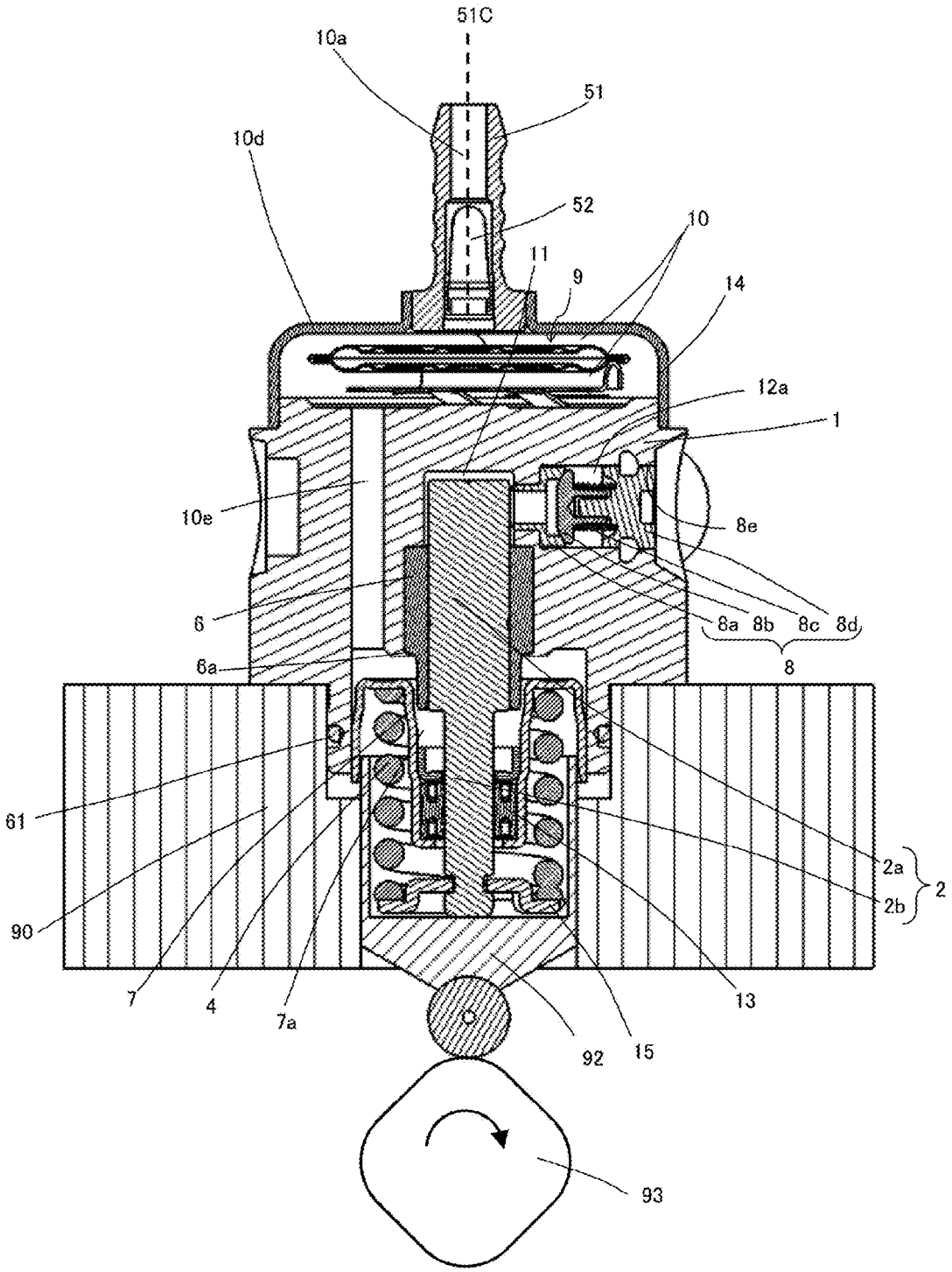
FIG. 8 is a vertical cross-sectional view of the high-pressure fuel pump, when seen from a direction different from the direction of FIG. 1, according to the second embodiment of the present invention.

Next, a high-pressure fuel pump according to a second embodiment of the present invention will be described by referring to FIGS. 6 to 8.

In the first embodiment, the intake joint 51 is provided on a side surface of the pump body 1 as illustrated in FIG. 3. In contrast, in the second embodiment, the intake joint 51 is provided on the upper surface of the damper cover 14 as illustrated in FIG. 6.

This embodiment can reduce the number of components and decrease the manufacturing cost. The intake joint 51 has an axis 51C that coincides with the axis of the damper cover 14, so that the intake joint 51 can be attached easily to the damper cover 14.

The present invention is not limited to the above-described embodiment, and may include various modifications. For example, the embodiment has been described in detail to facilitate the understanding of the present invention, and is not necessarily limited to the embodiment that includes the entire structure described above. The structure of the embodiment may partly be replaced by the structure of different embodiment, or the structure of different embodiment may be added to the structure of a certain embodiment. Further, some of the structures of respective embodiment may be added, deleted, or substituted for by other structures.

REFERENCE SIGNS LIST

1 pump body
2 plunger
6 cylinder
7 seal holder
8 discharge valve mechanism
9 metal damper (pressure pulsation decreasing mechanism)
9*a* holding member
10*a* low-pressure fuel inlet
11 pressurizing chamber
12 fuel discharge outlet
13 plunger seal
14 damper cover
30 intake valve
40 rod urging spring
43 electromagnetic coil
100 pressure-pulsation-propagation preventing mechanism
101 valve seat
102 valve
103 spring
104 spring stopper
200 relief valve
201 relief body
202 valve holder
203 relief spring
204 spring stopper
300 electromagnetic intake valve

The invention claimed is:

1. A high-pressure fuel pump, comprising:
a metal damper;
a damper housing that is formed in a pump body and houses the metal damper;
a damper cover attached to the pump body that covers the damper housing and the metal damper between the pump body and damper cover;
a holding member that is fixed to the damper cover and holds a lower side of the metal damper, wherein the lower side is a side of the damper that is opposite to the damper cover;
a fuel path formed through the holding member;
a communication path formed along an outer periphery of the holding member, wherein the communication path allows the lower side of the damper to communicate with an upper side of the damper; and
an elastic portion formed in the fuel path of the holding member, wherein the elastic portion urges the pump body so that the metal damper is urged toward the damper cover.

2. A high-pressure fuel pump, comprising:
a metal damper;
a damper housing that is formed in a pump body and houses the metal damper;
a damper cover attached to the pump body that covers the damper housing and the metal damper between the pump body and damper cover;
a holding member that is fixed to the damper cover by press fitting and holds the metal damper from a lower side of the metal damper, wherein the lower side is a side of the damper that is opposite to the damper cover;
a fuel path formed through the holding member;
a communication path formed along an outer periphery of the holding member, wherein the communication path allows the lower side of the damper to communicate with an upper side of the damper; and
an elastic portion formed in the fuel path of the holding member, wherein the elastic portion urges the pump body so that the metal damper is urged toward the damper cover.

3. The high-pressure fuel pump according to claim 1, wherein:
the holding member includes a bottom portion formed in an approximately flat shape, and
the elastic portion is formed from a part of the bottom portion that is cut and raised toward the pump body.

4. The high-pressure fuel pump according to claim 1, wherein:
the holding member includes
a bottom portion,
an inner peripheral side portion formed from the bottom portion toward the damper cover, and
an outer peripheral side portion formed from the inner peripheral side portion toward the bottom portion, and
the outer peripheral side portion is press-fitted into the damper cover to fix the holding member to the damper cover.

5. The high-pressure fuel pump according to claim 1, wherein
the holding member and the elastic portion are made of a single press plate.

6. The high-pressure fuel pump according to claim 1, wherein
the holding member is configured such that only the elastic portion touches the pump body.

7. The high-pressure fuel pump according to claim 1, wherein
the holding member is provided with a cutout on both left and right sides when seen from the upper side, so that the holding member is formed approximately in a rectangular shape.

8. The high-pressure fuel pump according to claim 1, wherein
the holding member includes a bottom portion formed in an approximately flat shape, and
a lower end of the damper cover is positioned lower than the bottom portion over an entire region of the bottom portion.

9. The high-pressure fuel pump according to claim 1, wherein:
the holding member includes a bottom portion formed in an approximately flat shape, the elastic portion is formed by a part of the bottom portion that is cut and raised toward the pump body, and a lower end of the damper cover is positioned lower than the elastic portion over an entire region of the elastic portion.

10. The high-pressure fuel pump according to claim 1, wherein before the damper cover is attached to the pump body, the metal damper is fitted to the damper cover with the holding member to form an independent unit.

11. The high-pressure fuel pump according to claim 2, wherein the holding member is provided with a cutout on both left and right sides when seen from the upper side, so that the holding member is formed approximately in a rectangular shape.

12. The high-pressure fuel pump according to claim 2, wherein the holding member includes a bottom portion formed in an approximately flat shape, and a lower end of the damper cover is positioned lower than the bottom portion over an entire region of the bottom portion.

13. The high-pressure fuel pump according to claim 2, wherein before the damper cover is attached to the pump body, the metal damper is fitted to the damper cover with the holding member to form an independent unit.

* * * * *